United States Patent [19]

Bare, Jr. et al.

[11] 4,394,975

[45] Jul. 26, 1983

[54] ROCK DUST BLOWER

[76] Inventors: Clyde A. Bare, Jr., Box 244; Buddy L. Bare, Box 714, both of Crab Orchard, W. Va. 25827; Walter A. Hill, Rte. 2 Box 1725, Beckley, W. Va. 25801

[21] Appl. No.: 279,853

[22] Filed: Jul. 2, 1981

[51] Int. Cl.[3] ..... A01C 3/06

[52] U.S. Cl. ..... 239/654; 239/143

[58] Field of Search ..... 239/143, 654, 85, 311

[56] References Cited

U.S. PATENT DOCUMENTS 3,415,450 12/1968 Hawk ..... 239/85

4,109,861 8/1978 McHugh ..... 239/143

*Primary Examiner*—Andres Kashnikow

*Assistant Examiner*—Gene A. Church

*Attorney, Agent, or Firm*—Frank P. Cyr

[57] ABSTRACT

A portable rock dust blowing apparatus comprising a wheel or skid supported framework upon which is mounted a blower designed to derive it's driving power from a belt engaging roller which is also supported on the framework. Also mounted on the framework is a pair of inverted U-shaped channel members which are employed for adjusting the framework relative to an endless belt travelling under the framework. A hopper for containing a rock dust or the like is used along with the aforesaid apparatus whereby the blower assembly will be employed for directing the rock dust on to the walls, ceiling and floor of a mine tunnel or shaft by one utilizing the rock dust blower of the present invention.

4 Claims, 6 Drawing Figures

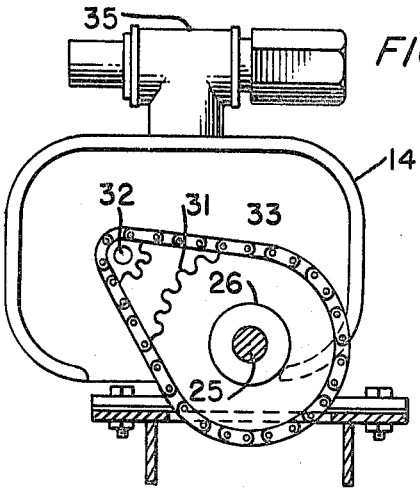
FIG. 4.
FIG. 6.
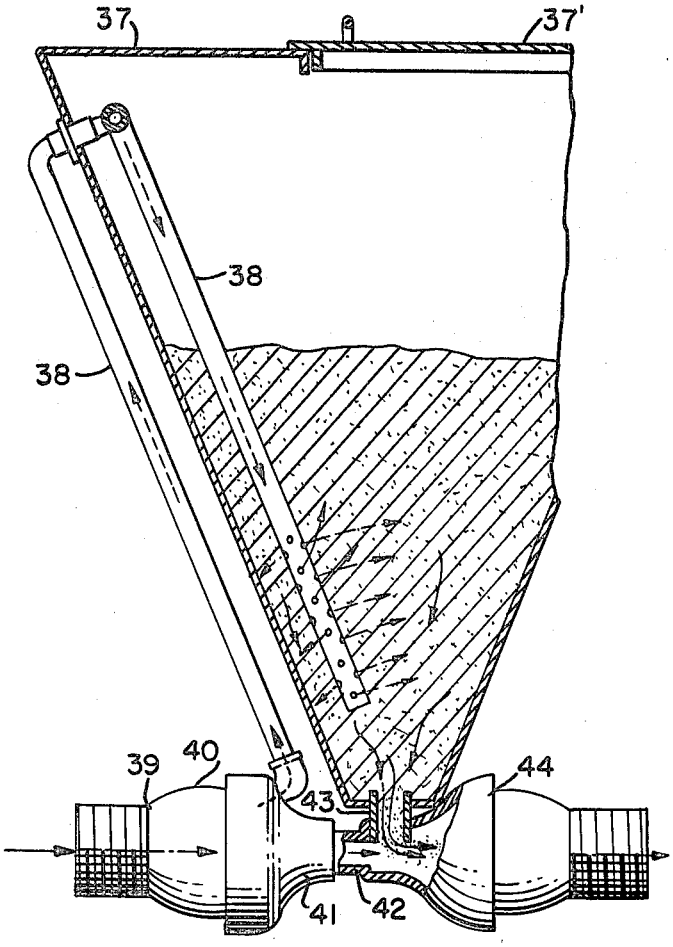
FIG. 5.
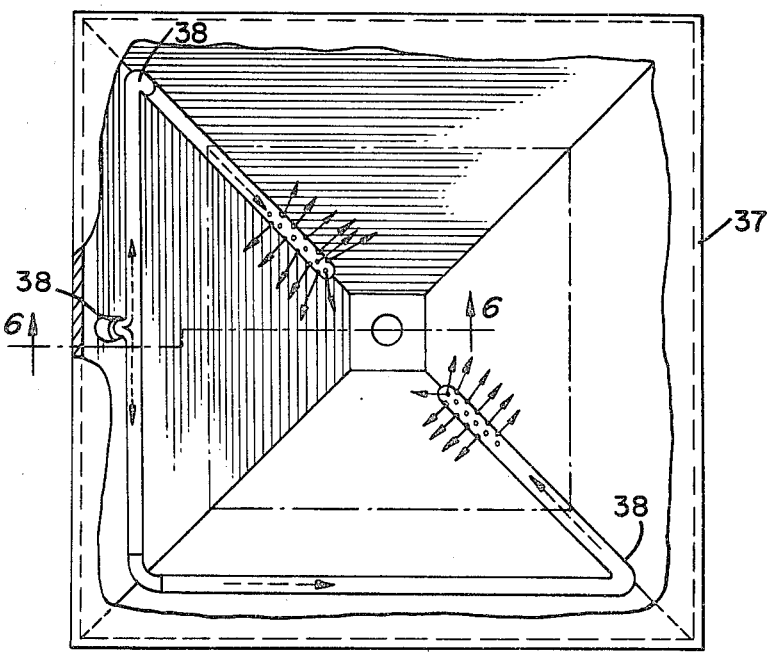

ROCK DUST BLOWER

BACKGROUND OF THE INVENTION

Through experimentation, the U.S. Bureau of Mines has concluded that a very effective manner of avoiding explosions in mines is to cover the coal dust generated by the mining machinery with a rock dust. As is well known, coal dust in a mine is highly combustible and unless some means is provided for eliminating the explosive characteristic of the dust, explosions may occur and since the same may be ignited by sparks emenating from some of the equipment employed in the mining operation, it is compulsory that such dust be abated and rendered non-explosive. Thus, rock dust is sprayed on the ceiling, walls and floor of a mine shaft or tunnel to thereby mix with the coal dust and thereby render the coal dust substantially non-explosive in character.

With the above in mind, it is one object of the invention to provide a portable unit which may be easily transported into a mine shaft or tunnel and employed to spray a rock dust onto the ceiling, walls and floor of a mine shaft or tunnel.

Another object of the invention is to so construct a rock dust device whereby the power required for operating the dusting machine is derived from the conveyor belt commonly employed in a mine for carrying the mined coal to a suitable discharge point.

Another object of the invention is to provide a portable rock dust spraying apparatus with a means whereby the same may be easily transported to the place of use and when at that location the portable apparatus may be secured to and suspended by roof supported cables.

Another object of the invention is to provide a rock dust container with pneumatic means extending thereinto whereby the dust is prevented from caking by reasons of continuous agitation of the dust in the container.

A still further object of the invention is to provide a Venturi means at the outlet of the container for the rock dust whereby when in operation, the Venturi means will aspirate some of the rock dust from within the container at the bottom outlet and feed the same into a suitable conduit and thence sprayed onto the surfaces of the mine shaft or tunnel.

A still further object of the invention is to mount a belt engaging roller on the framework for the rock duster, one end of the roller being journalled in a suitable bearing mounted on the framework for the rock duster and the other end of the roller rotating a gear wheel which is in driving connection with a blower or fan mounted in a suitable housing.

The invention also consists in certain other features of construction and in the combination and arrangement of the several parts to be hereinafter fully described, illustrated in the accompanying drawings and specifically pointed out in the appended claims.

DESCRIPTION OF THE DRAWINGS

FIG. 4 is an end view showing the power take-off for driving a blower or fan within a housing.

FIG. 5 is a top plan view showing the rock dust container of the present invention, and FIG. 6 is a section taken on line 6—6 of FIG. 5 looking in the direction of the arrow.

DESCRIPTION OF THE PREFERRED EMBODIMENT

Figure 1:
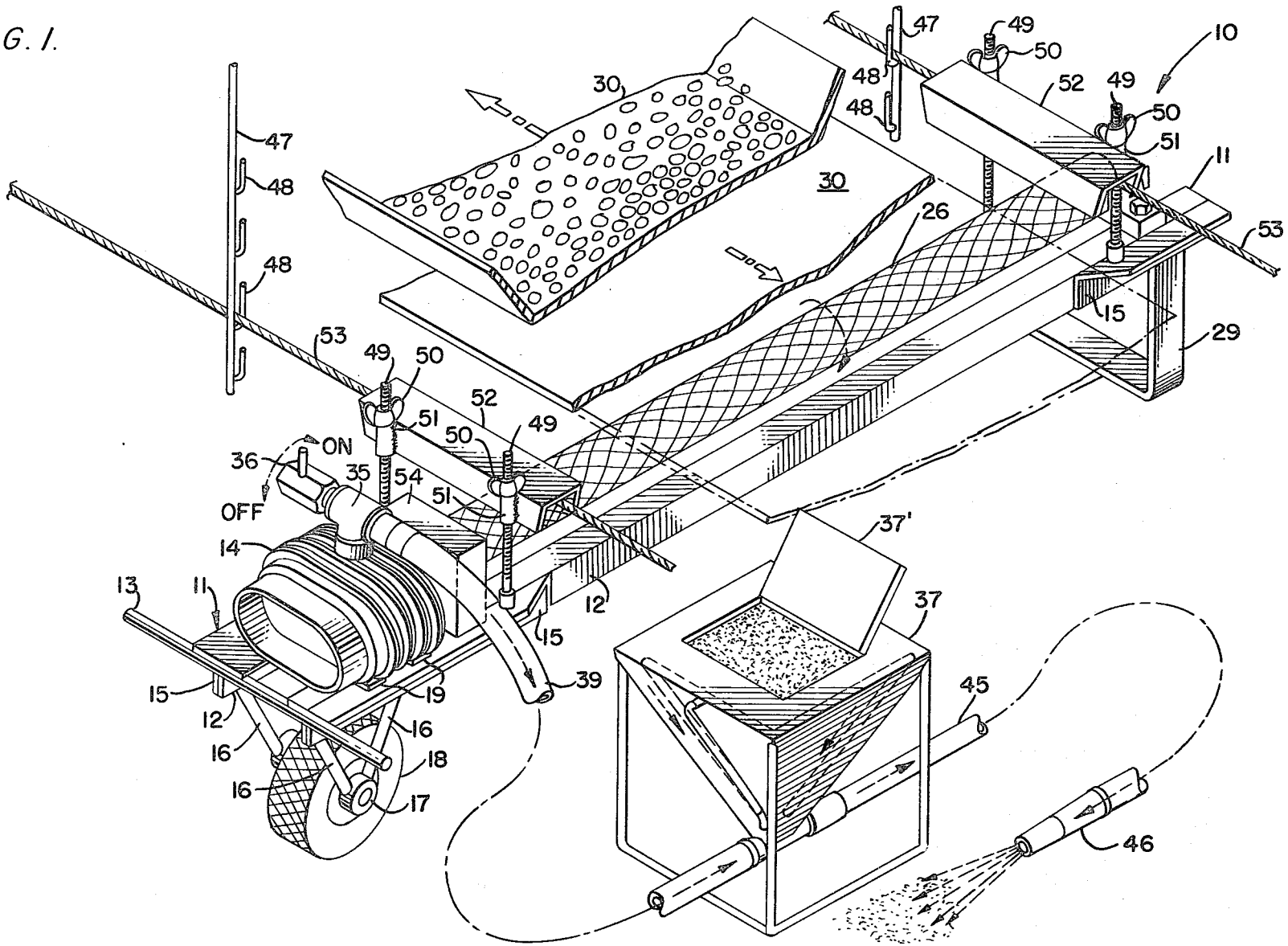
FIG. 1 is a side elevation with parts broken away showing the rock duster of the present invention.

Before undertaking a detailed description of the structure shown in the drawings, it is to be emphasized that the inventors herein have devised an apparatus for spraying rock dust into a mine tunnel or shaft which may be easily transported to the cite for use in spraying the ceiling, walls and floor of a mine tunnel or shaft. Rock dust spraying equipment in a coal mine is not entirely new. A number of devices have been devised to accomplish the placing of a rock dust on the interior walls of a mine shaft or tunnel to abate the danger of explosions due to the accumulation of coal dust in the mining areas. However, such prior devices have been quite complex in structure and have not been too efficient in results or have been too expensive to operate.

Referring now to the drawings wherein like reference numerals are employed for designating like parts throughout the several views, numeral 10 designates generally the rock duster of the present invention. The duster comprises a framework 11 constructed of L-shaped iron beams 12 extending parallel to each other and secured at one end as by welding, brazing or the like to a transverse rod 13. The duster includes a blower or housing 14 having mounted therein for rotation in any known manner, a fan (not shown). The fan or blower housing is mounted on a pair of L-shaped beams 15 which are secured by welding, brazing or the like to the parallel beams 12. Secured to the parallel beams 12 is a pair of diagonally disposed struts 16 which are secured in any known manner to a hub 17 on which is journaled for rotation a wheel member comprising the usual inflatable rubber tire 18. If desired, a skid of known construction may be substituted for the tire. In any event, whether a skid or wheel is employed for supporting one end of the framework, the same merely shows how the framework with the components thereon may be moved from one place to another. It should be pointed out at this time that the framework with the components mounted thereon is relatively light weight and may be easily handled by one person for moving the same from one area to another for performing it's intended function.

The fan or blower housing 14 is secured to the L-shaped beam 15 by means of ears 19 formed integral with or otherwise secured to the housing 14. Bolt members 20 extend through suitable openings found in the ears 19 and L-shaped beams 15 and nuts 21 engage with the bolts 20 for securing the housing to the framework 11. Also mounted on the framework 11 is a bearing block 22 of conventional design and the block 22 is secured to the framework 11 by means of bolts 23 which extend through suitable openings found in the L-shaped iron beams 12 and through openings formed in the ears 24 which are formed integral with or otherwise secured to the bearing block 22.

Mounted for rotation in the bearing block 22 is a shaft 25 which is keyed within roller 26 and adapted to rotate in unison therewith in a manner to be explained more fully hereinafter. The shaft 25 is likewise mounted for rotation in a bearing block 27 which is also mounted on the framework 11 by means of bolts 28 and nuts (not shown) as previously described with respect to the bearing block 22.

Figure 2:
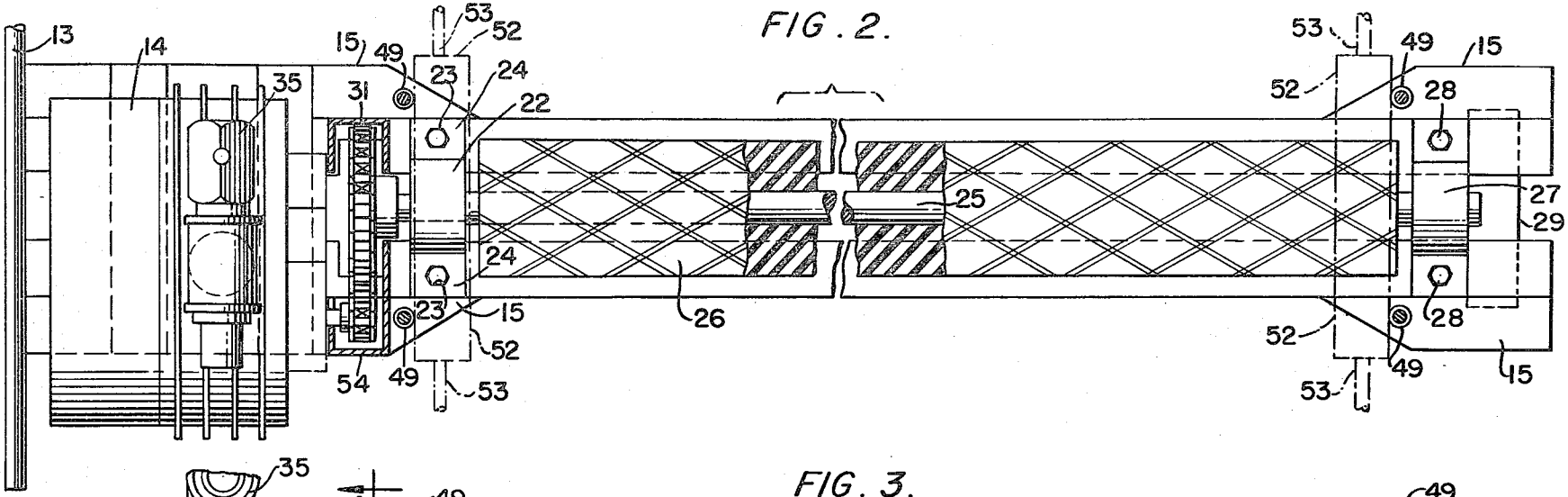
FIG. 2 is a top plan view with parts broken away showing the driving arrangement of the blower or fan for the rock duster.
Figure 3:
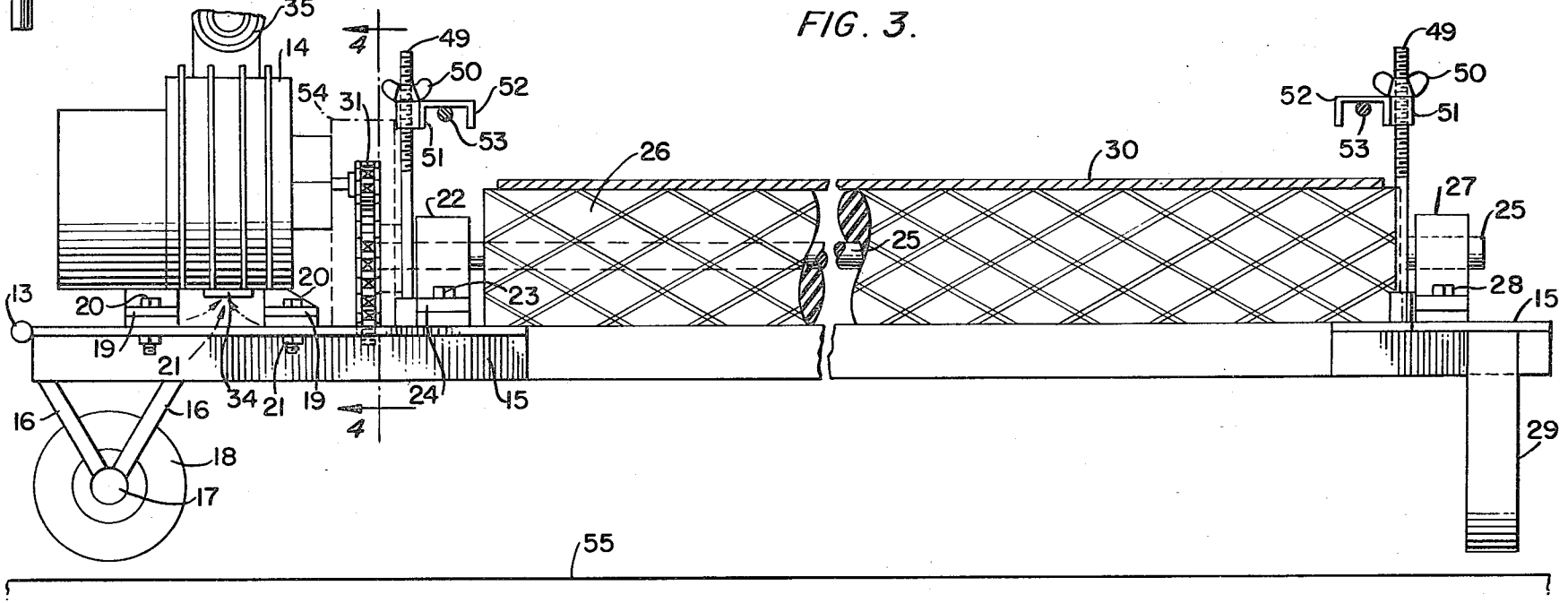
FIG. 3 is a side elevation of the structure shown in FIG. 2.

Having described the manner in which one end of the duster framework may be supported either by a wheel or skid arrangement, the other end of the framework is supported by means of a generally U-shaped arrangement of strap steel generally shown at 29 in FIGS. 1, 2 and 3 of the drawings. The strap steel formation 29 may be secured to the underside of the framework as by brazing, welding or the like.

The roller 26 is described as being made of rubber and the same may have on it's outer surface a series of indentations such as criss-cross undercuts or the like to increase the frictional engagement with the overriding belt of the conveyor belt 30 and to be adjustable with respect to the said belt 30 in a manner to be explained more fully hereinafter. Of course, the roller may be made of any known material even including a surface coated with an abrasive substance so as to increase the traction forces between the roller and the belt conveyor.

As stated previously, the unit is easily transportable from one area to the other so that the duster may be easily manipulated by one person to relocate the same within a mine shaft or mine tunnel.

The shaft 25 as more clearly shown in FIGS. 2, 3 and 4 of the drawings is connected to a gear 31 which is connected by a suitable spliced connection to the shaft 25. A driving connection between the gear 31 and a sprocket gear 32, see FIG. 4, is effected by a chain drive 33. As can be appreciated, a belt and pulley arrangement could be substituted to accomplish the same purpose.

The housing 14 comprises an air intake opening 34 in the lower portion of the fan housing 14 and has mounted thereon a coupling 35. Coupling 35 is secured to the fan housing in any known manner and includes an on and off contact switch designated generally at 36 whereby the operator of the duster may turn the apparatus to an on or off position. Actually, the on or off position of the valve switch 36 will permit for the entry or exclusion of outside air into the fan enclosure.

As best seen in FIG. 4 of the drawings, rotation of the gear 31 will cause an accelerated turning of the gear 32 which is the driving power for the blower or fan in the housing 14.

The aforesaid structured unit is designed to be transported to the place of use, and as aforesaid, this can be accomplished by one person handling the apparatus.

A rock dust container is to be employed with the aforesaid apparaus. The rock dust container comprises a generally hopper shaped container 37 into which extend a plurality of diffuser pipes 38 which are provided with a plurality of perforations such as shown in FIGS. 5 and 6 of the drawings. A cover 37' is provided at the upper end of the hopper whereby the rock dust may be deposited in the hopper. Located at the lower end of the hopper 37 is an air conduit 39 which is connected in any known manner to the output side of the blower or fan unit 14. A nipple 40 is integral with or otherwise secured to the conduit 39 and terminates at one end thereof with a reduced portion 41 which is integral with or otherwise secured to a conduit 42 which extends below the exit opening 43 provided at the lower end of the hopper 37. Secured in any known manner to the outlet opening 43 is an outlet conduit 44 which is externally threaded for engagement with a flexible conduit 45 to which a nozzle 46 is connected.

Thus, when the device is in operation and the switch 36 is turned to the On position, air which is being driven from the blower unit 14 will be directed into the conduit 39 and travels therein in the direction of the arrows shown in FIGS. 1 and 6 of the drawings. Some of the air from the conduit 39 will be diverted into conduit 38 and into the hopper and dispersed therein so as to continuously agitate the dust in the hopper so as to prevent caking of the dust whereas some of the air from conduit 39 will issue through the conduit 42 and in so doing will create a suction effect on the duct within the hopper and aspirate some of the dust and feed the same into the flexible conduit 45 and out through the nozzle 46.

Once the duster constructed as aforesaid is brought to location, the same is adapted to be supported by cables 53 and suspension rods 47 which are supported from the roof in any known manner. The rods 47 may be provided with spaced apart hooks 48. Secured to both ends of the framework 11 is a pair of externally threaded bolt members 49. Thumb nuts 50 each provided with a sleeve 51 are secured as by welding, brazing or the like to inverted channel members 52 which extend over the cables 53. Actually, the framework 11 is suspended off the floor 55 of the mine tunnel or shaft such as shown in FIG. 3 of the drawings, the same being totally supported by the aforesaid cables 53 and the suspension rods 47, so that the framework 11 may be raised or lowered with respect to the floor 55 of the mine by manipulating the aforesaid thumb nuts 50.

In operation, the endless conveyor 30 is driven through any suitable means and is designed to travel in the direction of the arrows shown in FIG. 1 of the drawings. As the lower reach of the belt 30 passes over the roller 26, and actually contacts the same and by reason of friction cause the roller to rotate. Rotation of the roller 26 will, through the aforesaid gearing, cause the blower to operate which will direct a flow of air through the conduit 39 and thence to the interior of the hopper and also out through the conduit 42 and ultimately through the nozzle 46.

Since the framework and parts thereon are capable of being elevated or lowered in the manner previously described, the roller 26 may be elevated or lowered so as to adjust the roller with respect to the travelling belt in order to insure a proper contact of the roller with the undersurface of the aforesaid travelling belt.

Thus it will be apparent that we have provided a rock duster which is designed to derive the power for operation of the same through the conveyor belt normally found in a mining operation. Also, since the rock dust blower of the present invention does not utilize any form of electric motor for operating the same, there is no danger of setting off an explosion in the mine by reason of electrical sparks normally seen coming from such an electric motor. This, of course, is an added safety feature for the rock dust blower of the present invention.

It will be obvious to those skilled in the art to make various changes, alterations and modifications to the invention described herein. To the extent that these changes, alterations and modifications do not depart from the spirit and scope of the appended claims, they are intended to be encompassed therein.

We claim:

1. A rock dust applying device comprising a framework having mounted thereon a roller adapted to engage with the undersurface of a travelling endless conveyor and to be rotated thereby, a gear train rotated by said roller, a blower mounted on said framework and being driven by said gear train, said blower directing a stream of air through a conduit which directs some of the air through a hopper to thereby agitate a rock dust contained therein which is to be sprayed on to the surface of a mine tunnel or shaft, said blower also directing a stream of air through a conduit extending below said hopper to aspirate some of the dust from within said hopper and to direct the rock dust laden air to a nozzle for spraying the surface of a mine shaft or tunnel with said rock dust laden air.

2. The structure recited in claim 1 wherein said framework is supported on a pair of cable members and wherein said framework may be elevated or lowered to thus increase or decrease the frictional contact of said roller with said travelling conveyor.

3. The structure recited in claim 1 wherein said rock dust applying device is suspended off the floor of the mine during operation thereof by means of cables and mine roof anchored rods.

4. The structure recited in claim 1 wherein said roller is rubber covered.

* * * * *